United States Patent [19]

Derencsenyi et al.

[11] Patent Number: 4,847,939

[45] Date of Patent: Jul. 18, 1989

[54] PROTECTIVE PAINTBRUSH SLEEVE

[76] Inventors: Tibor Derencsenyi, 21 Coleman Ct., San Carlos, Calif. 94070; Tim Hmelar, 3085 Middlefield Rd., #4, Palo Alto, Calif. 94306

[21] Appl. No.: 172,716

[22] Filed: Mar. 24, 1988

[51] Int. Cl.[4] ..... A46B 17/02

[52] U.S. Cl. ..... 15/246; 15/143 R; 15/168; 206/361; 16/110 R

[58] Field of Search ..... 15/168–170, 15/246, 257 R, 248 R, DIG. 4, 247, 175, 184; 16/110 R; 206/361, 362, 362.1, 362.3, 362.4, 15.2, 15.3

[56] References Cited

U.S. PATENT DOCUMENTS

| | | | |
|---|---|---|---|
| 816,793 | 4/1906 | Harris . | |
| 1,204,531 | 11/1916 | Wright . | |
| 1,612,887 | 1/1927 | Saunders | 206/361 |
| 2,263,119 | 11/1941 | Cornell . | |
| 2,485,068 | 10/1949 | Santana | 206/361 |
| 2,550,248 | 4/1951 | Holton . | |
| 3,088,645 | 5/1963 | Mechaneck . | |
| 3,331,493 | 7/1967 | Anglin . | |
| 4,469,223 | 9/1984 | Smith . | |
| 4,751,762 | 6/1988 | Meimeteas | 15/143 R X |

FOREIGN PATENT DOCUMENTS

| | | | |
|---|---|---|---|
| 417507 | 10/1934 | United Kingdom | 15/248 R |

*Primary Examiner*—Peter Feldman
*Attorney, Agent, or Firm*—Irell & Manella

[57] ABSTRACT

A sleeve device for protecting paintbrushes during soaking and storage comprises a resilient, generally rectangular body portion, having front and back faces, left and right sides, and a bottom opening, dimensioned to receive the brush stock and bristles; a neck portion having front and back faces continuous with the body portion's front and back faces, dimensioned to receive the brush handle; a shoulder region connecting the top of the body portion with the neck portion; and friction-/elastic-retaining means for releasably engaging the brush stock, brush handle, or both. The friction/elastic-retaining means preferably comprise internally-projecting ridges positioned on the left and right sides of the body portion and oriented parallel to the left and right sides, where the ridges exhibit a maximal intrusion near the shoulder region of the left and right faces, and decline to a minimal intrusion near the bottom opening.

8 Claims, 4 Drawing Sheets

PROTECTIVE PAINTBRUSH SLEEVE

DESCRIPTION

1. Technical Field

This invention relates to a device for preserving and maintaining brushes, particularly paintbrushes, before and after use.

2. Background

The common paintbrush is one of mankindn's more ancient tools. Although the brush has progressed, from a simple stick with animal fur lashed to one end, to modern brushes with nylon or natural bristles set in metal ferrules, the brush was and is subject to a host of ills that occur once the brush has been used. The characteristics of paint that make it useful, e.g., adhesion and durability, make it troublesome to remove from paintbrushes. The thinner or solvent incorporated in paint can dry the brush out, leaving the bristles stiff and useless. Once the brush has been cleaned, it is an awkward object to store. It must be hung to dry lest the bristles be bent by the weight of the brush, or the cleaning solution soak into the supporting surface. It is generally inconvenient to set the brush aside until fully dry. Hence, many have experimented with methods for cleaning and storing paintbrushes after their use.

Devices for protecting paintbrushes as they dry typically comprise either a sealed cup, so that the brush may be soaked in thinner, or an open sleeve, which keeps the bristles in their proper form. Sealed cup devices often suffer from an inadequate seal with common brushes, necessitating the use of a special brush adapted to seal the cup. The need for specially-designed brushes however limits the usefulness of such devices. Sleeve-type devices generally support the brush in a vertical position, bearing the weight of the brush to keep the bristles from bending. For a sleeve device to be acceptable, it must be resistant to commonly-encountered paints, paint thinners and solvents (including turpentine). If used for soaking the brush, it must allow solvent to enter and paint to exit. If used for storage, it must allow air to circulate through the bristles. Further, it should keep the bristles in their original shape, preventing the bristles from splaying or bending as the brush soaks or dries. The device should also be easy to clean, and as inexpensive as possible.

Representative disclosures of brush storage devices in the art include the following U.S. patents: Harris, U.S. Pat. No. 816,793 (Apr. 6, 1906) disclosed a device for storing paintbrushes in an upright position. The disclosed device is essentially a flared free-standing cup for holding turpentine. The cup has a hook positioned at the top so that one may guide the brush bristles into the cup while inserting the brush. The flared shape of the cup is intended to press the bristles together and maintain the normal shape of the brush. The top of the cup and the brush are adapted to form an airtight seal, e.g., by positioning a rubber gasket around the brush stock.

Wright, U.S. Pat. No. 1,204,531 (Nov. 14, 1916) disclosed another cup-type device for suspending a paintbrush in turpentine. The cup has a two-part head section which receives the stock, and is wrapped in packing material to form an airtight seal in the top of the cup.

Saunders, U.S. Pat. No. 1,612,887 (Jan. 24, 1925) disclosed a paintbrush stand, for protecting brushes while standing in a can of thinner. The device is a rectangular metal sleeve designed to slip over the brush handle to cover the bristles. The sleeve is longer than the bristles, so that the bristles do not bear the weight of the handle, and do not contact the sediment often found in the bottom of used soaking cans. The sleeve bears internal indentations at the top to frictionally engage the stock and hold the brush in place.

Cornell, U.S. Pat. No. 2,263,119 (Nov. 18, 1941) disclosed a wedge-shaped brush retainer, consisting of two perforated metal plates joined by a hinge. The brush is inserted at the end opposite the hinge, and held in place by a spring clamp. The perforations allow free circulation of turpentine and dissolving paint.

Holton, U.S. Pat. No. 2,550,248 (Apr. 24, 1951) disclosed a brush holder for maintaining a brush while soaking. The holder consists of a sheet metal sleeve flared at the bottom to aid in insertion, and held in place by a spring clamp. The sides are perforated to allow circulation.

Smith, U.S. Pat. No. 4,469,223 (Sept. 4, 1984) disclosed a ferruleless paintbrush and holder, where the holder is either completely enclosed (for brushes with detachable handles) or seals to the brush stock. The cup is thus airtight, and is designed to contain thinner or cleaning fluid. The cup is preferably fabricated from plastic resistant to paint solvents.

DISCLOSURE OF THE INVENTION

We have now invented an improved sleeve device for maintaining brushes, particularly paintbrushes, during drying and storage. The holder comprises a resilient, elastomeric, generally rectangular body portion, having front and back faces, left and right sides, and a bottom opening, dimensioned to receive said brush stock and bristles; a resilient elastic neck portion having front and back faces continuous with said body portion front and back faces, dimensioned to receive said brush handle; a shoulder region connecting the top of said body portion with said neck portion; and friction/elastic-retaining means positioned on the inner surface of said body for releasably engaging said brush stock, brush handle, or both.

The resulting sleeve device is more convenient to use than the metal devices of the prior art, and is not susceptible to rusting. As the device is resilient, it may be stepped on or bent, and will merely return to its original shape, without losing its usefulness. The claimed device also provides means for hanging while the brush is drying, thus allowing one to hang brushes even if the brush itself is not provided with convenient means for hanging.

MODES OF CARRYING OUT THE INVENTION

Figure 1:
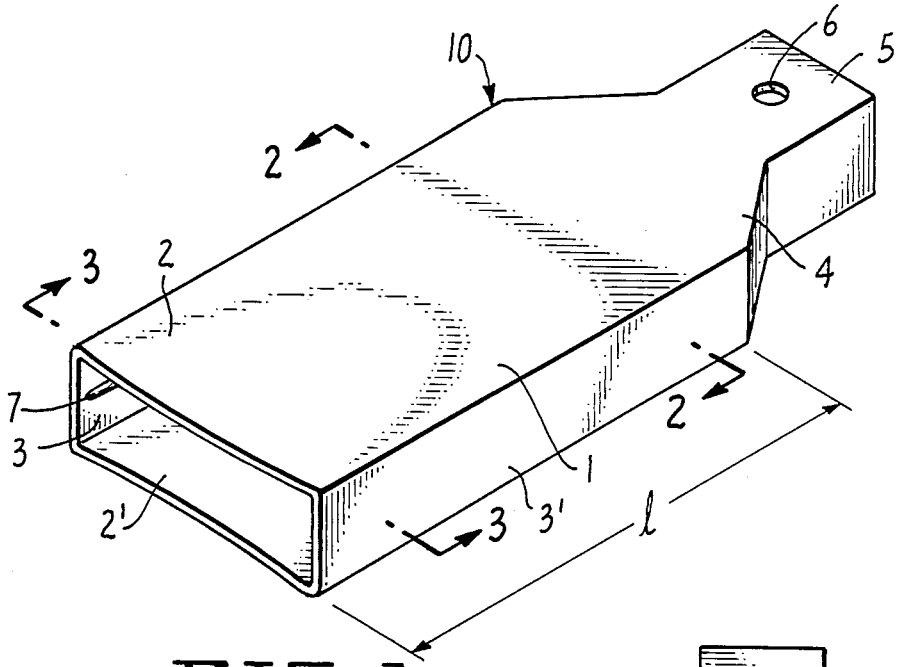
FIG. 1 depicts a perspective elevation of an embodiment of the invention.
Figure 2:
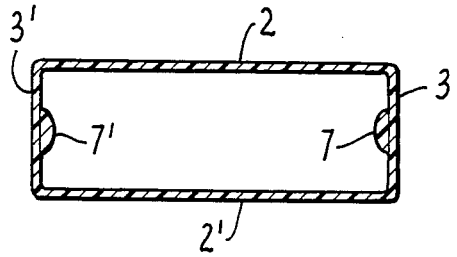
FIG. 2 depicts a cross-sectional view of the embodiment of FIG. 1 near the shoulder region.
Figure 3:
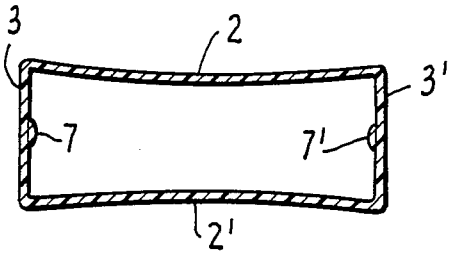
FIG. 3 depicts a cross-sectional view of the embodiment of FIG. 1 near the bottom opening.

A. Detailed Description and Preferred Embodiments:

One presently preferred embodiment of the invention is a device for soaking and storing paintbrushes after use, for use in combination with a brush having a handle portion, a stock portion generally rectangular in cross section, and a bristle portion. As shown in FIG. 1, the device 10 of this invention comprises a resilient, generally rectangular body portion 1, having front and back faces 2 and 2', and left and right sides 3 and 3', defining a bottom opening. This bottom opening is dimensioned to receive the brush stock and bristles, and long enough in dimension "1" to prevent the bristles from extending past the end of the device 10 when the brush is fully inserted. The device has a neck portion 5 which has front and back faces continuous with the body portion front and back faces, and having sides such that the neck is dimensioned to receive the handle of the paintbrush. The device also has a shoulder region 4 which connects the top of the body portion to the neck portion. The device 10 also includes friction/elastic-retaining means 7 and 7' for releasably engaging the brush stock, brush handle, or both. The friction/elastic-retaining means can be ridges, 7 and 7', projecting from the internal surface of the left and right faces 3 and 3'. These ridges are tapered such that the ridge excursion is at its greatest near the shoulder region, and at its least near the bottom opening. This feature is shown in more detail in FIGS. 2 and 3. In these figures the top and bottom 2 and 2' and sides 3 and 3' are shown. By comparing FIG. 2, a cross-section taken near the shoulder region and FIG. 3, a cross-section taken near the bottom opening, it can be seen that the ridges 7 and 7' increase in size near the shoulder region. These figures also illustrate another advantageous feature of this invention which is that in the part of the body portion near the bottom opening the top and bottom surfaces are both somewhat concave. This allows the brush protector to press the bristles into a smooth, tapered point while still permitting a firm base for standing up the brush holder with the brush enclosed.

Due to the elastic nature of the brush protector this concavity can be deformed when the brush is inserted and pulled into the holder.

Thus, in use, the paintbrush is easily inserted, handle first, through the bottom opening, and is inserted until the retaining ridges engage by friction/elastic properties the sides of the brush stock. The brush is inserted far enough to cause a slight deformation of the sleeve, thus providing enough tension and friction to maintain the brush in place. This deformation will be further described with reference to FIGS. 6 and 7.

Figure 4:
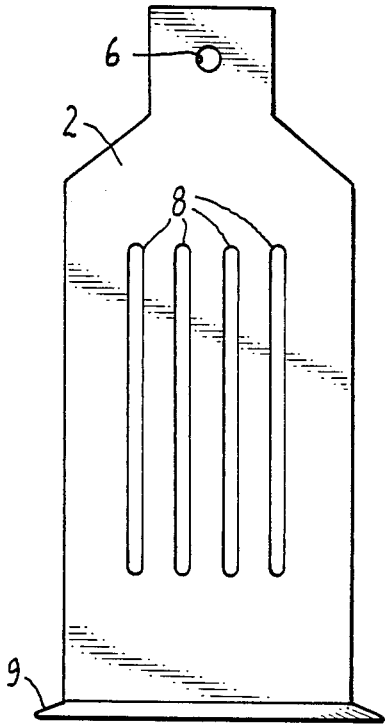
FIG. 4 depicts a plane view of another embodiment of the invention.

In another presently preferred embodiment, the device 10 includes fenestrations on at least one of its front or back faces 2 and 2'. This embodiment is illustrated in FIG. 4 where the fenestrations 8 may be holes, perforations, elongated slots or the like, and may if desired be covered by mesh. Optionally, the neck portion of the device further comprises means for suspending or hanging the brush cover. One form of such hanging means is perforation 6 in the front or back face dimensioned to engage a nailhead or pegboard hook. The device of this invention can also optionally include a flared bottom opening 9. This can be provided to achieve the following desirable ends: (1) it provides a broader, more stable base upon which to stand the brush holder; (2) it provides stiffening and thus greater structural integrity to the bottom opening portion of the brush holder.

Figure 5:
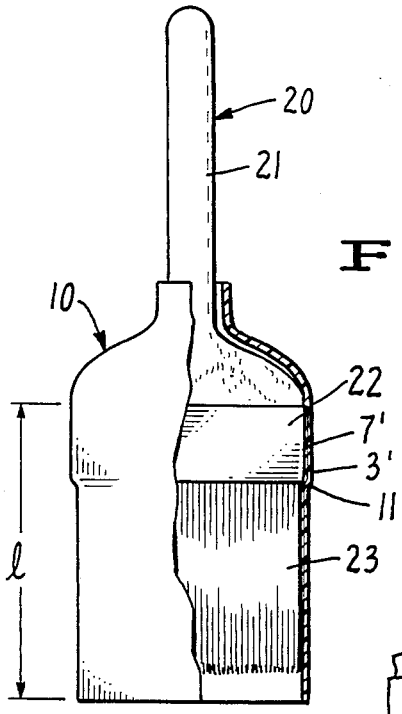
FIG. 5 illustrates a brush in combination with an embodiment of the invention in cutaway.
Figure 6:
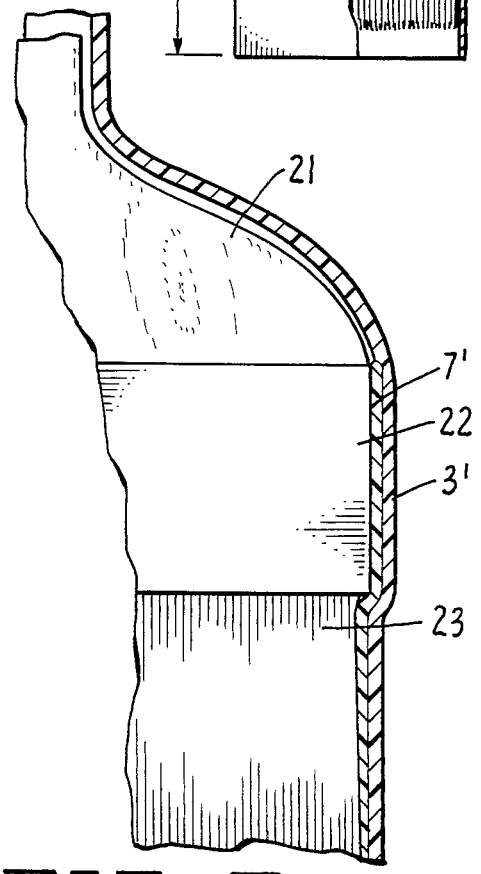
FIG. 6 is an enlargement of a portion of FIG. 5 illustrating the releasable engagement of the brush stock with the brush holder by means of one form of friction-/elastic-retaining means.
Figure 7:
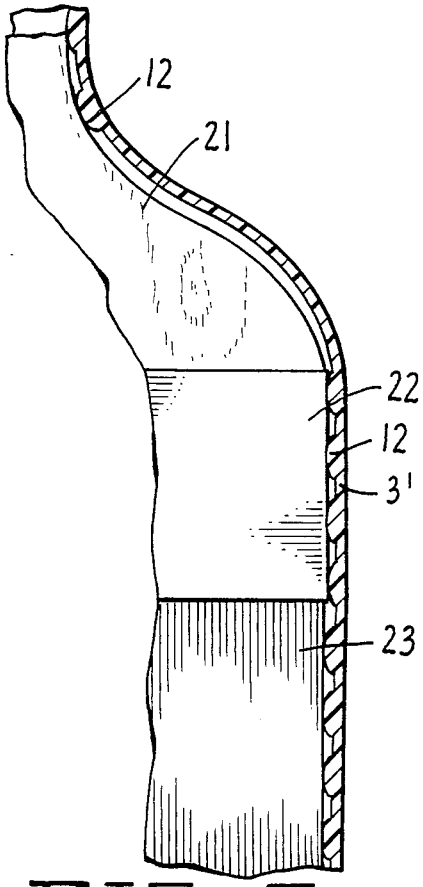
FIG. 7 is a view like FIG. 6 showing an alternative form of friction/elastic-retaining means.

Turning to FIG. 5 and enlargements shown in FIGS. 6 and 7, in each case a brush holder 10 is shown enclosing and protecting a brush 20. Brush 20 includes a handle 21, a stock 22 and bristles 23. As can be seen in each of these figures, the distance "1" provided by the brush holder exceeds the length of the bristles 23 so that the bristles are fully protected and not exposed. As can be seen in all three figures, as the brush is fully inserted into the brush protector it deforms the brush protector somewhat. This is shown by the bulge 11 occurring where the brush stock ultimately lodges. This deformation can be achieved by pushing against rib 7'. In an alternative embodiment, as shown in FIG. 7, instead of sloping internal ridges, the friction/elastic-retaining means may take the form of dimples 12 or other projections. These can be positioned on the interior surface of the front and/or back faces 2 and 2', or on the interior surface of the left and right sides 3 and 3'. It is this latter embodiment which is shown in FIG. 7.

The devices of the invention are suitable for fabrication from any appropriate polymer that is sufficiently resistant to common paints, paint thinners and solvents, turpentine, and the like. Exemplary materials are known to those in the chemical industry generally, and include flexible polyvinyl chloride (PVC), polyethylene, polypropylene, stiff butyl rubber, and the like. It will be appreciated by those of skill in the art that the resilience of the device may be achieved by varying the construction and composition of the walls. For example, a softer polymer may be employed by designing the body portion with reinforcing exterior ribs. Conversely, a relatively rigid polymer may be employed by forming sufficiently thin walls, or designing thin spots at points where flexation is necessary. Preferably, the plastic will be characterized as a "soft flex," roughly 60–80 as measured by a Shore A Durometer. Polyvinyl chloride is the presently preferred material.

Devices of the invention may conveniently be fabricated by any appropriate plastic forming technique, such as mandrel dipping, molding, injection molding, and the like, preferably by mandrel dipping techniques. Generally, a mandrel of appropriate shape is prepared (usually from machined metal), and is dipped into a container of prepolymer, e.g., polyvinyl chloride plastisol. The mandrel is typically heated, so that polymerization occurs on the surface of the mandrel. The mandrel is then removed, and the polymer coat allowed to set. This procedure may be repeated until a polymer coat of desired thickness is achieved. The polymer is then stripped off the mandrel, trimmed, and packaged for shipment.

B. Examples

The following examples are presented in illustration, but not limitation, of the invention.

EXAMPLE 1

A tapered-ridge sleeve of the invention suitable for a size 2" brush is prepared as follows:

A mandrel was first prepared from a cast aluminum block by machining it to dimensions of 5.50"×2.30"×0.50" (body portion), 1.00"×1.10"×0.50" (neck portion), with a shoulder region of 0.60" sloping in from the body portion to the neck portion. Next, a groove was machined into the narrow sides of the body portion, 0.130" deep at the shoulder region tapering to 0.001" at the bottom opening. The resulting mandrel was then polished, and prepared for dipping.

The mandrel, heated to 450° F. was dipped (neck portion down) into polyvinyl chloride plastisol at room temperature, for 4 minutes, then withdrawn.

The resulting molded sleeve was then oven cured at 450° F. for 3 minutes, stripped from the mandrel, trimmed at the neck, and a hole punched in the back face of the neck portion. One may also optionally fenestrate the body portion at this point.

What is claimed:

1. A brush holder for use in combination with a brush having a handle portion, a stock portion generally rectangular in cross section, and a bristle portion, which holder comprises:

a resilient, generally rectangular body portion, having front and back faces, left and right sides, and a bottom opening, dimensioned to receive said brush stock and bristles;

a neck portion having front and back faces continuous with said body portion front and back faces, dimensioned to receive said brush handle;

a shoulder region connecting the top of said body portion with said neck portion; and friction-retaining means for releasably engaging said brush stock, brush handle, or both;

wherein said friction-retaining means comprises an internally-projecting ridge positioned on at least a left or right side of said body portion and oriented parallel to said left or right side, where said ridge exhibits a maximal intrusion near the shoulder region of said left or right face, and declines to a minimal intrusion near said bottom opening.

2. The device of claim 1 wherein said front and back faces are concave near the bottom opening.

3. The device of claim 1 wherein at least a front face or back face is fenestrated.

4. The device of claim 3 wherein said neck portion further comprises hanging means.

5. The device of claim 4 wherein said hanging means comprises a perforation in said front or back face of said neck portion.

6. The device of claim 1 wherein said body portion further comprises a stabilizing base means, positioned at said bottom opening.

7. A brush holder for use in combination with a brush having a handle portion, a stock portion generally rectangular in cross section, and a bristle portion, which holder comprises:

a resilient, generally rectangular body portion, having front and back faces, left and right sides, and a bottom opening, dimensioned to receive said brush stock and bristles, said front and back faces being concave near said bottom opening, and at least a front face or back face being fenestrated;

a neck portion having front and back faces continuous with said body portion front and back faces, dimensioned to receive said brush handle, said neck portion further comprising a perforation in said front or back face dimensioned to receive hanging means;

a shoulder region connecting the top of said body portion with said neck portion; and friction-retaining means for releasably engaging said brush stock, brush handle, or both, said friction-retaining means comprises internally-projecting ridges positioned on said left and right sides of said body portion and oriented parallel to said left and right sides, where said ridges exhibit a maximal intrusion near the shoulder region of said left and right faces, and decline to a minimal intrusion near said bottom opening.

8. The holder of claim 7, wherein said holder comprises polyvinyl chloride.

* * * * *